US006823321B2

(12) United States Patent
Johnson et al.

(10) Patent No.: US 6,823,321 B2
(45) Date of Patent: Nov. 23, 2004

(54) METHOD AND SYSTEM FOR OPTIMIZING REFILL AMOUNT FOR AUTOMATIC REFILL OF A SHARED VIRTUAL POSTAGE METER

(75) Inventors: Robert J. Johnson, Naugatuck, CT (US); Fuming Ye, Stamford, CT (US); Manu Sarin, Naugatuck, CT (US); Thomas Shokite, North Haven, CT (US); James R. Tobin, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 666 days.

(21) Appl. No.: 09/952,543

(22) Filed: Sep. 14, 2001

(65) Prior Publication Data

US 2003/0055794 A1 Mar. 20, 2003

(51) Int. Cl.[7] ..... G07B 17/00
(52) U.S. Cl. ..... 705/403; 705/410
(58) Field of Search ..... 705/401, 403, 705/410

(56) References Cited

U.S. PATENT DOCUMENTS

| | | | | |
|---|---|---|---|---|
| 5,812,991 A | * | 9/1998 | Kara | 705/410 |
| 6,064,993 A | | 5/2000 | Ryan, Jr. | 705/403 |
| 6,151,590 A | | 11/2000 | Cordery et al. | 705/60 |
| 6,151,591 A | | 11/2000 | Pierce et al. | 705/401 |
| 6,157,919 A | | 12/2000 | Cordery et al. | 705/60 |
| 6,175,826 B1 | | 1/2001 | Malandra, Jr. et al. | 705/410 |
| 6,202,057 B1 | | 3/2001 | Pierce | 705/400 |
| 6,362,724 B1 | * | 3/2002 | Rosenau | 340/5.2 |
| 2003/0055794 A1 | * | 3/2003 | Johnson et al | 705/403 |

FOREIGN PATENT DOCUMENTS

| | | | |
|---|---|---|---|
| EP | 0717376 A2 | * | 6/1996 |
| GB | 2188877 A | * | 10/1987 |

OTHER PUBLICATIONS

Fontana: "Serving up a simple solution. (Ipswitch's Imail Server 4.0 e–mail software)(Product Announcement"; Communications Week, May 5, 1997, No. 661, p. 8.*

* cited by examiner

*Primary Examiner*—Edward R. Cosimano
(74) *Attorney, Agent, or Firm*—Brian A. Lemm; Angelo N. Chaclas

(57) ABSTRACT

A method and system for dynamically optimizing the amount of an automatic refill of a shared virtual postage meter is disclosed. A desired time between refills is predetermined based on the capacity of the system to perform refills, the time required to process a refill, and the impact of performing a refill on the overall performance of the system. A refill amount candidate is then determined based on the predetermined desired time between refills, the elapsed time since the last refill and the amount of the last refill. The determined refill amount candidate is then further validated to insure that it falls within a range of a predetermined minimum and maximum refill amounts. Once validated, the refill amount candidate is the optimal refill amount, and the shared virtual postage meter is refilled accordingly.

30 Claims, 2 Drawing Sheets

METHOD AND SYSTEM FOR OPTIMIZING REFILL AMOUNT FOR AUTOMATIC REFILL OF A SHARED VIRTUAL POSTAGE METER

FIELD OF THE INVENTION

The invention disclosed herein relates generally to virtual postage meter systems, and more particularly to a method and system for optimizing the refill amount for automatic refill of a shared virtual postage meter.

BACKGROUND OF THE INVENTION

Since the invention of the postage meter by Arthur H. Pitney, it has evolved from a completely mechanical postage meter to a meter that incorporates extensive use of electronic components. Presently, postage metering systems are recognized as either closed or open system devices. In a closed system device, the system functionality is solely dedicated to metering activity. Examples of closed system metering devices include conventional digital and analog postage meters wherein a dedicated printer is securely coupled to a metering or accounting function. In a closed system device, since the printer is securely coupled and dedicated to the meter, printing cannot take place without accounting. In an open system device, the printer is not dedicated to the metering activity. This frees the system functionality for multiple and diverse uses in addition to the metering activity. Examples of open system metering devices include personal computer (PC) based devices with single/multi-tasking operating systems, multi-user applications and digital printers. An open system metering device includes a non-dedicated printer that is not securely coupled to a secure accounting module.

One version of an open metering system, referred to herein as a "virtual meter", includes a personal computer, referred to herein as the "host PC," without a metering (accounting) device, commonly referred to as a postal security device (PSD), coupled thereto. The host PC runs client metering applications, but all PSD functions are performed at a Data Center with which the host PC communicates via a network, such as, for example, a Local Area Network (LAN) or the Internet. The PSD functions at the Data Center may be performed in a secure device attached to a computer at the Data Center, or may be performed in the computer itself. The host PC must connect with the Data Center to process transactions such as postage dispensing, meter registration, or meter refills. Transactions are requested by the host PC and sent to the Data Center for remote processing. The transactions are processed centrally at the Data Center and the results are returned to the host PC. Accounting for funds and transaction processing are centralized at the Data Center.

In typical virtual postage meter systems, each user or associated group of users is paired with a unique virtual postage meter. Thus, there is a one-to-one correspondence between each user and their associated virtual postage meter. An associated group of users may be, for example, specified employees of a single business, wherein the business has an associated virtual postage meter that is accessible by the specified employees. Under this one-to-one correspondence arrangement, the user will determine the timing and amount of refill for the postage meter, and initiate a refill accordingly. To process a refill, the Data Center typically must communicate with a server that will provide the requested amount of postage funds and debit the user's account accordingly. Users will generally try to minimize the amount of funds available in the virtual postage meter system to limit potential loss should a third party tamper with the system and steal the funds stored therein. Thus, by minimizing the amount of funds stored therein, potential exposure is greatly reduced. Accordingly, a user will consider several factors, including, for example, typical daily usage, anticipated use in the future, etc. and determine when a refill should occur and the amount of the refill.

Another version of an open metering system is known as a shared virtual postage meter system. A shared virtual postage meter system is similar to the virtual postage meter system previously described, with the exception that it is shared among multiple users. Thus, there is not a one-to-one correspondence between each user and a virtual postage meter, but instead a many-to-one correspondence between multiple users and a single virtual postage meter. Each user can maintain an account with the Data Center that will be debited when a dispense request is processed, or alternatively, other payment options, such as, for example, credit card, can be used to purchase postage funds, by each user.

There are problems, however, with shared virtual postage meter systems. For example, since the shared virtual postage meter is shared by multiple users, the system, and not the users, must determine when a refill should occur and the amount of the refill. It is still desirous to minimize the amount of funds available in the shared virtual postage meter system to limit potential loss should a third party tamper with the system and steal the funds stored therein. Additionally, from a system standpoint, it is desirous to limit the number of refills that occur, as during a refill operation the system is unavailable for use by the users and each refill takes time to complete. If the refill of a virtual postage meter were truly instantaneous and the server providing the refill functionality could process an infinite number of refills, it would not be necessary to keep any funds in the postage meter and the meter could be refilled when a dispense request is made by a user. This would keep the amount of funds in the virtual postage meter as the lowest possible level without affecting response time. Since refills are not instantaneous and the Data Center can only handle a finite number of refills per time period, it is necessary to optimize the refill amount without adversely affecting system performance.

Thus, there exists a need for a method and system for optimizing the amount of an automatic refill of a shared virtual postage meter that will reduce the risk of potential loss by minimizing the amount of funds stored therein while maintaining dispensing performance and not adversely affecting system performance by requesting too many refills.

SUMMARY OF THE INVENTION

The present invention alleviates the problems associated with the prior art and provides a method and system for dynamically optimizing the amount of an automatic refill of a shared virtual postage meter. The method and system of the present invention reduces the risk of potential loss by minimizing the amount of funds stored in a shared virtual postage meter, while maintaining dispensing performance by not requesting too many refills based upon selection of an efficient desired time between refills.

In accordance with the present invention, a desired time between refills is predetermined based on the capacity of the system to perform refills, the time required to process a refill, and the impact of performing a refill on the overall performance of the system. A refill amount candidate is then determined based on the predetermined desired time between refills, the elapsed time since the last refill and the amount of the last refill. The determined refill amount candidate is then further validated to insure that it falls within a range of predetermined minimum and maximum refill amounts. Once validated, the refill amount candidate is the optimal refill amount, and the meter is refilled accordingly.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
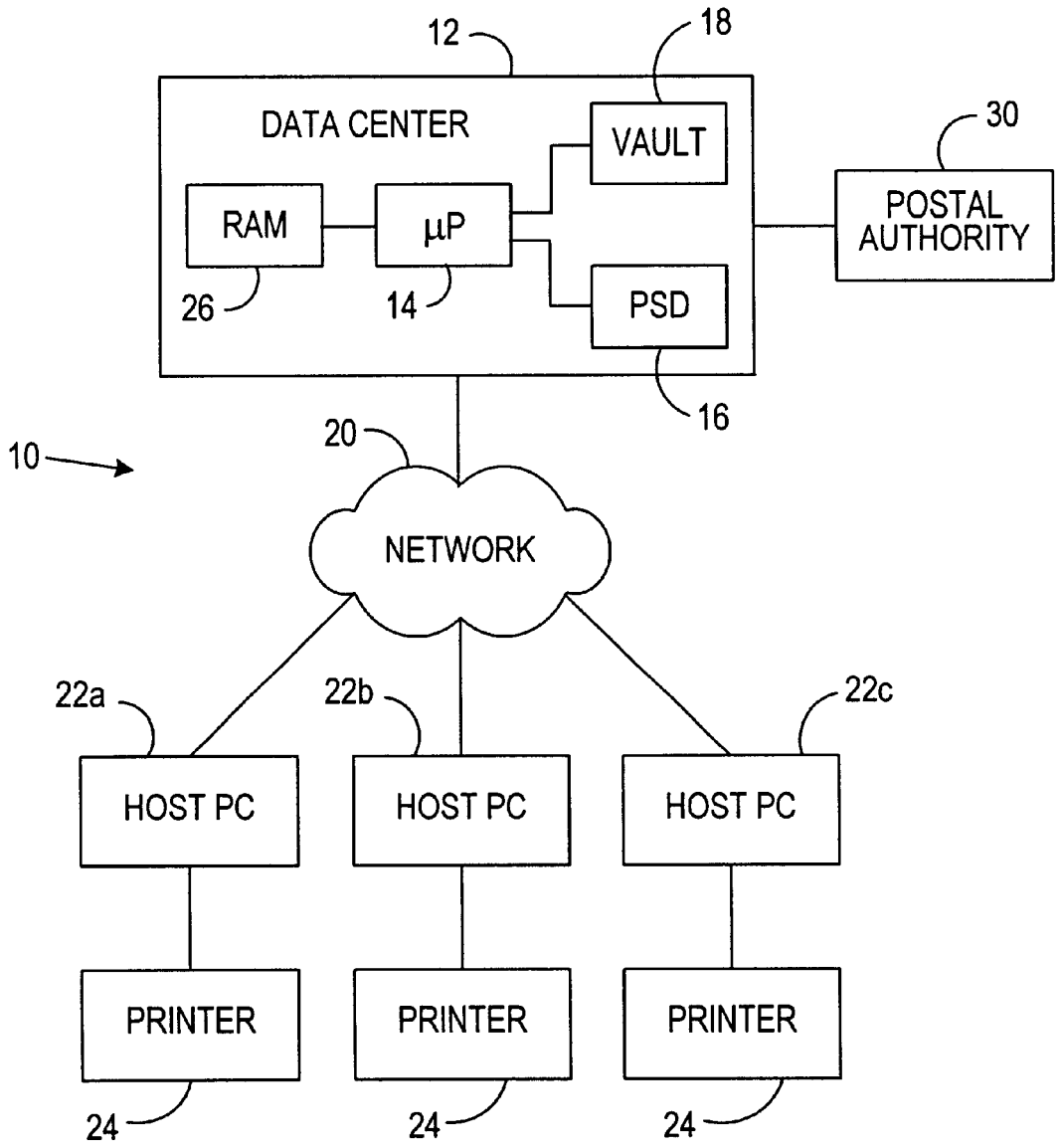
FIG. 1 illustrates in block diagram form a system according to the present invention.

In describing the present invention, reference is made to the drawings, wherein there is seen in FIG. 1 a virtual postage meter system 10 according to the present invention. The system 10 includes a Data Center 12. Operation of the Data Center 12 is coordinated and controlled by a processor, such as, for example, microprocessor 14. Monetary value, such as, for example, postage funds, are stored in Data Center 12 in a vault 18. System 10 further includes a plurality (three shown for clarity) of host personal computers 22*a*, 22*b*, 22*c*. Each host PC 22*a*, 22*b*, 22*c* is typically associated with a different user. Each host PC 22*a*–22*c* includes a conventional personal computer system with display, keyboard, and an unsecured printer 24. Each of the host PCs 22*a*–22*c* communicate with Data Center 12 via network 20 to access virtual postage funds, thereby making system 10 a shared virtual postage meter system 10. Network 20 may be, for example, the Internet. Accounting and dispensing of the postal funds at the Data Center 12 may be performed in the microprocessor 14 of Data Center 12, or alternatively may be performed in an optional secure device, such as, for example, PSD 16, coupled to the microprocessor 14.

The operation of system 10 is as follows. A user seeking to dispense postage will access Data Center 12 via one of the host PCs 22*a*–22*c* and network 20. Processor 14 processes all transactions at the Data Center 12. When the request to dispense postage is received, processor 14 will verify account information of the user, confirm sufficient funds for the requested amount are available in vault 18, and, if sufficient funds are available, perform cryptographic operations, such as token generation. The generated tokens, which indicate postage value, are then sent to the host PC 22*a*–22*c* that requested such dispensing for printing on mail pieces via printer 24.

Periodically, the amount of funds stored in vault 18 must be refilled. When this is necessary, Data Center 12 establishes a communication with postal authority 30 and requests a refill of funds. Data center 12 could have a direct communication with postal authority 30 as illustrated, or alternatively, could communicate via network 20. Postal authority 30 will provide the requested funds. Since system 10 is a shared virtual postage meter, the determination as to when a refill should occur and the amount of the refill must be made by the system 10, and not one of the users via a host PC 22*a*–22*c*. According to the present invention, a method and system for optimizing the amount of an automatic refill of vault 18 is provided that will reduce the risk of potential loss by minimizing the amount of funds stored therein while maintaining dispensing performance of system 10 and not adversely affecting system 10 performance by requesting too many refills.

Figure 2:
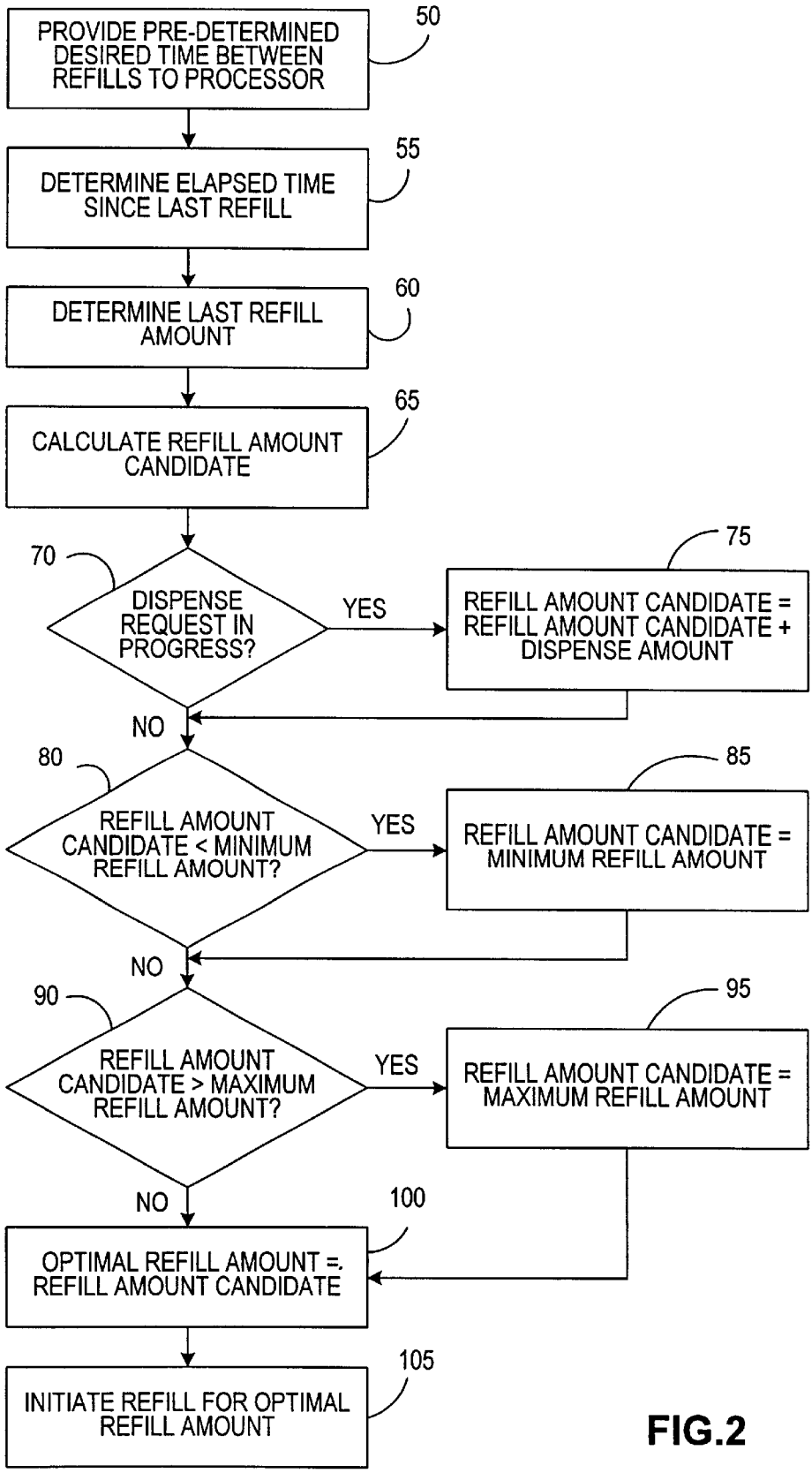
FIG. 2 illustrates in flow diagram form a process of determining an optimal refill amount according to the present invention.

Referring now to FIG. 2, a process of determining an optimal refill amount according to the present invention is illustrated in flow diagram form. This determination is calculated by processor 14 of Data Center 12 based on several variables as will be described below. The method starts in step 50 where a predetermined desired time between refills is provided to processor 14. The desired time between refills is based on several factors, including, for example, the capacity of the Data Center 12 to perform refills, the time required for the Data Center 12 to process a refill, and the impact on the system 10 of performing a refill. For example, Data Center 12 may be capable of performing a refill operation only once per day, in which case the desired time between refills would be twenty-four hours. Alternatively, Data Center 12 may have the capacity to perform any number of refill operations, but each refill operation takes a specified amount of time to complete. In this situation, the desired time between refills may be one or two hours. It should be understood that the above examples are illustrative only, and that the desired time between refills can be set to any amount of time as desired within the capacity constraints of the Data Center 12.

In step 55, processor 14 will determine the elapsed time since the last refill operation occurred. This can be computed, for example, by subtracting the time of the last refill operation from the current time as measured by a clock internal to processor 14. In step 60, the amount of funds received in the preceding refill operation is retrieved by processor 14. This amount may be stored, for example, in a memory device, such as Random Access Memory (RAM) 26, coupled to processor 14. Alternatively, the amount of the last refill could also be stored in a register or database in Data Center 12.

In step 65, a Refill Amount Candidate is calculated based on the information received in steps 50, 55 and 60 by the following equation:

$$AC=(DT/ET)*LR \tag{1}$$

where AC is the Refill Amount Candidate, DT is the desired time between refills from step 50, ET is the elapsed time since the last refill from step 55 and LR is the amount of the last refill from step 60. Thus, the determination of the Refill Amount Candidate takes into account the amount of time that was required to consume the prior refill amount with individual dispense requests received from host PCs 22*a*–22*c*.

In step 70, it is determined if a dispense request from a host PC 22*a*–22*c* is currently in progress. If a dispense request is presently in progress, then in step 75 the Refill Amount Candidate is updated to be the Refill Amount Candidate calculated by equation (1) in step 65 plus the amount of the dispense request. If in step 70 it is determined that a dispense request is not currently in progress, or after the Refill Candidate Amount is updated in step 75, then the Refill Amount Candidate is further validated as follows. In step 80, it is determined if the Refill Amount Candidate is less than a predetermined minimum refill amount. The minimum refill amount may be, for example, some multiple of the current postage rate for first class mail. For example, the minimum refill amount may be set to three times or five times the first class postage rate. If in step 80 it is determined that the Refill Amount Candidate is less than the predetermined minimum refill amount, then in step 85 the Refill Amount Candidate is updated to be equal to the predetermined minimum refill amount.

If in step 80 it is determined that the Refill Amount Candidate is not less than the minimum refill amount, or after the Refill Amount Candidate is updated to be the minimum refill amount in step 85, then in step 90 it is determined if the Refill Amount Candidate is greater than a predetermined maximum refill amount. For example, the maximum refill amount may be set to the maximum amount allowed to be stored in the meter by the United States Postal Service (USPS) or other postal authority. This maximum refill amount provides additional protection by limiting the amount of any potential loss should the integrity of Data Center 12 be compromised by a party fraudulently gaining access to Data Center 12. If in step 90 it is determined that the Refill Amount Candidate is greater than the maximum refill amount, then in step 95 the Refill Amount Candidate is updated to be equal to the predetermined maximum refill amount.

If in step 90 it is determined that the Refill Amount Candidate is not greater than the maximum refill amount, or after the Refill Amount Candidate is updated to be the maximum refill amount in step 95, then in step 100 the Optimal Refill Amount is set equal to the current Refill Amount Candidate. In step 105, Data Center 12 will initiate a refill operation and request a refill in the amount of the determined Optimal Refill Amount. The initiation of a refill operation can be triggered by one or more factors, such as, for example, a specified time of day, falling below a threshold level of funds stored in vault 18, or receiving a dispense request for an amount greater than the amount currently stored in vault 18. It should be noted that a refill request may be postponed due to the time of the day, or day of the week or year.

Since the actual time since the last refill from step 55 and the amount of the last refill from step 60 are based on the preceding refill operation, the determination of the Optimal Refill Amount is a dynamic process that is continuously updated based on the current dispensing activity of Data Center 12. By optimizing the amount of a refill, the value stored in vault 18 can be kept to a minimum while still providing efficient and timely service of any dispense requests made by a host PC 22*a*–22*c*.

Thus, according to the present invention, a method and system for dynamically optimizing the amount of an automatic refill of a shared virtual postage meter is provided. The method and system of the present invention reduces the risk of potential loss by minimizing the amount of funds stored in a shared virtual postage meter, while maintaining dispensing performance by not requesting too many refills based upon selection of an efficient desired time between refills.

It should be understood that although the present invention was described with respect to a postage metering system, the present invention is not so limited and is applicable to any type of shared value metering system in which refills of a meter are performed. In addition, the present invention is not limited to shared value metering systems, but is also applicable to value metering systems that are not shared as well. While a preferred embodiment of the invention has been described and illustrated above, it should be understood that this is exemplary of the invention and is not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A method for determining a refill amount for funds stored in a value dispensing meter comprising the steps of:

calculating a refill amount candidate, said refill amount candidate being based in part on an elapsed time since a preceding refill operation and an amount of funds refilled in said preceding refill operation;

comparing said refill amount candidate with a predetermined range; and setting said refill amount to said refill amount candidate if said refill amount candidate is within said predetermined range.

2. The method according to claim 1, wherein said step of calculating further comprises:

determining a desired time between refills of said funds stored in said value dispensing meter;

determining an elapsed time since a preceding refill operation;

determining an amount of funds refilled in said preceding refill operation; and calculating said refill amount candidate by dividing said desired time between refills by said elapsed time since a preceding refill operation to obtain a result, and multiplying said result by said amount of funds refilled in said preceding refill operation.

3. The method according to claim 2, further comprising:

determining if a dispense request is in progress; and adding an amount of funds requested in said dispense request to said calculated refill amount candidate if a dispense request is in progress.

4. The method according to claim 1 or 3, wherein said step of comparing further comprises:

determining if said refill amount candidate is less than a predetermined minimum refill amount for said value dispensing meter;

updating said refill amount candidate to be said predetermined minimum refill amount if said refill amount candidate is less than said predetermined minimum refill amount for said value dispensing meter; and setting said refill amount to be said updated refill amount candidate.

5. The method according to claim 4, wherein if said refill amount candidate is not less than said predetermined minimum refill amount for said value dispensing meter, said refill amount is set to said refill amount candidate.

6. The method according to claim 5, wherein said step of comparing further comprises:

determining if said refill amount candidate is greater than a predetermined maximum refill amount for said value dispensing meter;

updating said refill amount candidate to be said predetermined maximum refill amount if said refill amount candidate is greater than said predetermined maximum refill amount for said value dispensing meter; and setting said refill amount to be said updated refill amount candidate.

7. The method according to claim 6, wherein if said refill amount candidate is not greater than said predetermined maximum refill amount for said value dispensing meter, said refill amount is set to said refill amount candidate.

8. A method for refilling funds stored in a postage meter system comprising the steps of:

calculating a refill amount candidate by dividing a desired time between refill operations by an elapsed time since a preceding refill operation to obtain a result, and multiplying said result by an amount of funds of said preceding refill operation;

validating said calculated refill amount candidate, said validation comprising the steps of:

determining if said refill amount candidate is less than a predetermined minimum refill amount for said postage meter system;

updating said refill amount candidate to be said predetermined minimum refill amount if said refill amount candidate is less than said predetermined minimum refill amount for said postage meter system;

determining if said refill amount candidate is greater than a predetermined maximum refill amount for said postage meter system; and updating said refill amount candidate to be said predetermined maximum refill amount if said refill amount candidate is greater than said predetermined maximum refill amount for said postage meter system;

said method further comprising:

refilling said postage meter system in an amount equal to said validated refill amount candidate.

9. The method according to claim 8, wherein said step of calculating further comprises:

determining if a dispense request is in progress; and adding an amount of funds requested in said dispense request to said calculated refill amount candidate if a dispense request is in progress.

10. The method according to claim 8, wherein said step of refilling said postage meter system is initiated by said postage meter system.

11. The method according to claim 10, wherein said initiation is triggered by said funds stored in said postage meter system dropping below a predetermined threshold.

12. The method according to claim 10, wherein said initiation is triggered by a time of day.

13. The method according to claim 10, wherein said initiation is triggered by receipt of a dispense request for an amount of funds greater than an amount of funds currently stored in said postage meter system.

14. A value dispensing meter system comprising:

a data center, said data center including a vault for storing funds therein; and a host computer coupled to said data center via a network, said host computer adapted to access said data center via said network to request dispensing of funds stored in said vault, said data center further comprising a processor, said processor determining a refill amount for funds stored in said vault and initiating a refill of said funds in said refill amount, said determination comprising the steps of:

calculating a refill amount candidate, said refill amount candidate being based in part on an elapsed time since a preceding refill operation and an amount of funds refilled in said preceding refill operation; and comparing said refill amount candidate with a predetermined range;

wherein if said refill amount candidate is within said predetermined range, said refill amount is set to said refill amount candidate.

15. The system according to claim 14, wherein said step of calculating further comprises:

determining a desired time between refills of said funds stored in said vault;

determining an elapsed time since a preceding refill operation;

determining an amount of funds refilled in said preceding refill operation; and calculating said refill amount candidate by dividing said desired time between refills by said elapsed time since a preceding refill operation to obtain a result, and multiplying said result by said amount of funds refilled in said preceding refill operation.

16. The system according to claim 15, wherein said determination by said processor further comprises:

determining if a dispense request from said host computer is in progress; and adding an amount of funds requested in said dispense request to said calculated refill amount candidate if a dispense request is in progress.

17. The system according to claim 14 or 16, wherein said step of comparing further comprises:

determining if said refill amount candidate is less than a predetermined minimum refill amount for said data center;

updating said refill amount candidate to be said predetermined minimum refill amount if said refill amount candidate is less than said predetermined minimum refill amount for said data center; and setting said refill amount to be said updated refill amount candidate.

18. The system according to claim 17, wherein if said refill amount candidate is not less than said predetermined minimum refill amount for said data center, said refill amount is set to said refill amount candidate.

19. The system according to claim 18, wherein said step of comparing further comprises:

determining if said refill amount candidate is greater than a predetermined maximum refill amount for said data center;

updating said refill amount candidate to be said predetermined maximum refill amount if said refill amount candidate is greater than said predetermined maximum refill amount for said data center; and setting said refill amount to be said updated refill amount candidate.

20. The system according to claim 19, wherein if said refill amount candidate is not greater than said predetermined maximum refill amount for said data center, said refill amount is set to said refill amount candidate.

21. The system according to claim 14, wherein said network is the Internet.

22. The system according to claim 14, wherein said value dispensing meter system is a virtual postage meter system.

23. The system according to claim 14, further comprising:

a plurality of host computers coupled to said data center via said network, each of said plurality of host computers adapted to access said data center via said network to request dispensing of funds stored in said vault.

24. A virtual postage meter system comprising:

a data center, said data center including a vault for storing funds therein; and a host computer coupled to said data center via a network, said host computer adapted to access said data center via said network to request dispensing of postage funds stored in said vault, said data center further comprising a processor, said processor determining a refill amount for postage funds stored in said vault and initiating a refill of said postage funds in said refill amount, said determination comprising the steps of:

calculating a refill amount candidate by dividing a desired time between refill operations by an elapsed time since a preceding refill operation to obtain a result, and multiplying said result by an amount of funds of said preceding refill operation;

validating said calculated refill amount candidate, said validation comprising the steps of:

determining if said refill amount candidate is less than a predetermined minimum refill amount for said postage meter system;

updating said refill amount candidate to be said predetermined minimum refill amount if said refill amount candidate is less than said predetermined minimum refill amount for said postage meter system;

determining if said refill amount candidate is greater than a predetermined maximum refill amount for said postage meter system; and updating said refill amount candidate to be said predetermined maximum refill amount if said refill amount candidate is greater than said predetermined maximum refill amount for said postage meter system;

said method further comprising:

refilling said vault of said data center in an amount equal to said validated refill amount candidate.

25. The system according to claim 24, wherein said step of calculating further comprises:

determining if a dispense request is in progress; and adding an amount of funds requested in said dispense request to said calculated refill amount candidate if a dispense request is in progress.

26. The system according to claim 24, wherein said initiation by said processor is triggered by said funds stored in said vault dropping below a predetermined threshold.

27. The system according to claim 24, wherein said initiation by said processor is triggered by a time of day.

28. The system according to claim 24, wherein said initiation by said processor is triggered by receipt of a dispense request for an amount of funds greater than an amount of funds currently stored in said vault.

29. The system according to claim 24, wherein said network is the Internet.

30. The system according to claim 24, further comprising:

a plurality of host computers coupled to said data center via said network, each of said host computers adapted to access said data center via said network to request dispensing of postage funds stored in said vault, wherein said virtual postage meter system is a shared virtual postage meter system.

* * * * *